US010871338B2

(12) United States Patent
Williams et al.

(10) Patent No.: US 10,871,338 B2
(45) **Date of Patent: *Dec. 22, 2020**

(54) HALF-COCK TRIGGER SAFETY ASSEMBLY

(71) Applicant: Springfield, Inc., Geneseo, IL (US)

(72) Inventors: Charles David Williams, Geneseo, IL (US); Thomas E. Long, Downers Grove, IL (US)

(73) Assignee: Springfield, Inc., Geneseo, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/416,311

(22) Filed: May 20, 2019

(65) Prior Publication Data

US 2019/0301825 A1 Oct. 3, 2019

Related U.S. Application Data

(63) Continuation of application No. 15/674,932, filed on Aug. 11, 2017, now Pat. No. 10,330,413.

(60) Provisional application No. 62/373,680, filed on Aug. 11, 2016.

(51) Int. Cl.

| | |
|---|---|
| ***F41A 17/46*** | (2006.01) |
| ***F41A 17/74*** | (2006.01) |
| ***F41A 19/10*** | (2006.01) |
| ***F41A 17/48*** | (2006.01) |
| ***F41A 19/42*** | (2006.01) |
| *F41A 19/15* | (2006.01) |

(52) U.S. Cl.

CPC ..... *F41A 17/74* (2013.01); *F41A 17/48* (2013.01); *F41A 19/10* (2013.01); *F41A 19/42* (2013.01); *F41A 19/15* (2013.01)

(58) Field of Classification Search

CPC ..... F42A 17/46; F42A 17/56; F42A 17/74; F42A 17/82; F41A 17/46; F41A 17/56; F41A 17/74; F41A 17/82

See application file for complete search history.

(56) References Cited

U.S. PATENT DOCUMENTS

| | | | |
|---|---|---|---|
| 109,513 | A | 11/1870 | Hay |
| 161,117 | A | 3/1875 | Hadley |
| 644,402 | A | 2/1900 | Bye |
| 1,147,906 | A | 7/1915 | Swebilius et al. |
| 1,227,531 | A | 5/1917 | Donadio |
| 1,896,820 | A | 2/1933 | Jolidon |
| 2,037,065 | A | 4/1936 | Burton |
| 2,189,202 | A | 2/1940 | Garland |
| 2,341,033 | A | 2/1944 | Garland |

(Continued)

FOREIGN PATENT DOCUMENTS

| | | |
|---|---|---|
| EP | 0 982 557 B1 | 6/2006 |

*Primary Examiner* — J. Woodrow Eldred
(74) *Attorney, Agent, or Firm* — Woodard, Emhardt, Henry, Reeves & Wagner, LLP

(57) ABSTRACT

Trigger assemblies that preserve the integrity of the trigger sear surface when the trigger assembly enters a "half-cocked", safety configuration are disclosed. In certain embodiments, a trigger safety engagement surface engages a hammer safety engagement surface in the safety configuration, preventing the hammer from rotating into contact with a firing pin. In some instances, the trigger sear surface is suspended within a safety recess (e.g., a notch) of the hammer and free of contact with the hammer when the trigger assembly is in the safety configuration.

20 Claims, 7 Drawing Sheets

(56) References Cited

U.S. PATENT DOCUMENTS

| | | | |
|---|---|---|---|
| 2,406,980 | A | 9/1946 | Young |
| 2,464,427 | A | 3/1949 | Wilson |
| 2,703,943 | A | 3/1955 | Roemer |
| 2,855,716 | A | 10/1958 | Campbell |
| 3,152,418 | A | 10/1964 | Charron |
| 3,251,268 | A | 5/1966 | Menneking |
| 3,292,492 | A | 12/1966 | Sturtevant |
| 3,803,741 | A | 4/1974 | Ducommun |
| 4,017,996 | A | 4/1977 | Liedke |
| 4,589,327 | A | 5/1986 | Smith |
| 5,086,579 | A | 2/1992 | Flatley et al. |
| 5,166,458 | A | 11/1992 | Yoo |
| 5,625,971 | A | 5/1997 | Tuma et al. |
| 5,712,443 | A | 1/1998 | Canaday et al. |
| 5,724,759 | A | 3/1998 | Kilham |
| 5,760,328 | A | 6/1998 | Robbins |
| 5,881,485 | A | 3/1999 | Milazzo |
| 5,913,261 | A | 6/1999 | Guhring et al. |
| 6,119,387 | A | 9/2000 | Butters et al. |
| 6,125,735 | A | 10/2000 | Guhring |
| 6,283,006 | B1 | 9/2001 | Szabo et al. |
| 6,341,442 | B1 | 1/2002 | Szabo et al. |
| 6,381,892 | B1 | 5/2002 | Szabo et al. |
| 7,600,338 | B2 | 10/2009 | Geissele |
| 7,854,084 | B1 | 12/2010 | Rutherford |
| 8,220,192 | B2 | 7/2012 | Fluhr et al. |
| 9,146,066 | B1 | 9/2015 | Cason |
| 9,310,150 | B1 | 4/2016 | Geissele |
| D764,004 | S | 8/2016 | Bender |
| 9,733,034 | B1 | 8/2017 | Viani |
| 10,330,413 | B2 * | 6/2019 | Williams ..... F41A 19/42 |
| 2003/0126782 | A1 | 7/2003 | Baker |
| 2004/0237954 | A1 | 12/2004 | Styles et al. |
| 2006/0048428 | A1 | 3/2006 | Thomele et al. |
| 2006/0101695 | A1 | 5/2006 | Longueira |
| 2009/0183414 | A1 | 7/2009 | Geissele |
| 2010/0229843 | A1 | 9/2010 | Hu |
| 2011/0079137 | A1 | 4/2011 | Audibert et al. |
| 2011/0315002 | A1 | 12/2011 | Keough |
| 2015/0153125 | A1 | 6/2015 | Lutton et al. |
| 2015/0153126 | A1 | 6/2015 | Bender |
| 2015/0178304 | A1 | 6/2015 | Gross |
| 2015/0253094 | A1 | 9/2015 | Reynolds |
| 2015/0253095 | A1 | 9/2015 | Wilson |
| 2015/0330727 | A1 | 11/2015 | Kolev et al. |
| 2015/0330734 | A1 | 11/2015 | Kolev et al. |
| 2015/0338181 | A1 | 11/2015 | McAlister |
| 2015/0362274 | A1 | 12/2015 | Merlino et al. |
| 2016/0010933 | A1 | 1/2016 | Bonner |
| 2016/0018176 | A1 | 1/2016 | Fellows et al. |
| 2016/0061549 | A1 | 3/2016 | Patterson et al. |
| 2016/0131448 | A1 | 5/2016 | Bender |
| 2016/0131449 | A1 | 5/2016 | Horch |
| 2016/0153732 | A1 | 6/2016 | Geissele |
| 2016/0161202 | A1 | 6/2016 | LaRue |
| 2016/0363401 | A1 | 12/2016 | Elftmann |
| 2017/0089655 | A1 | 3/2017 | Geissele |
| 2017/0089656 | A1 | 3/2017 | Alicea, Jr. |
| 2017/0108304 | A1 | 4/2017 | Heizer |
| 2017/0122686 | A1 | 5/2017 | Fellows et al. |
| 2017/0321983 | A1 | 11/2017 | Bender |
| 2018/0045481 | A1 | 2/2018 | Williams et al. |
| 2018/0087858 | A1 | 3/2018 | Geissele |
| 2018/0087860 | A1 | 3/2018 | Sullivan et al. |

* cited by examiner

HALF-COCK TRIGGER SAFETY ASSEMBLY

BACKGROUND

The present disclosure pertains generally to trigger assemblies for firearms. In particular, the present disclosure is applicable to trigger assemblies, including drop-in trigger modules, containing a trigger and hammer. In certain aspects, the present disclosure provides trigger assemblies for AR style firearms including but not limited to M16/AR15 and AR10 style rifles and pistols.

To protect against an unintentional discharge of a firearm, firearm and trigger manufacturers have designed and implemented various safety mechanisms. There remains, however, a desire for new and improved safety mechanisms.

SUMMARY

Trigger assemblies can include a trigger having a trigger sear surface that engages with a hammer sear surface of a hammer when the hammer is retained in a cocked position. To release the hammer, the trigger is moved rearward to disengage the trigger sear surface from the hammer sear surface. When the trigger sear surface is disengaged from the hammer sear surface, the hammer is free to rotate forward, under force of a biasing spring, and subsequently into contact with a firing pin.

In single stage triggers, the trigger sear surface disengages from the hammer sear surface when a sufficient force has been applied to the trigger to overcome the friction between the trigger sear surface and hammer sear surface and, in many instances, slightly rotate the hammer rearward. In many two-stage triggers, the "first stage" functions similar to that of a single stage trigger, with the operator having to overcome the friction between the trigger sear surface and the hammer sear surface. In the "second stage", the "trigger pull" by the operator presses a disconnector against the hammer to compress a disconnector spring before the trigger sear surface is disengaged from the hammer sear surface, thus releasing the hammer for rotation towards the firing pin.

To decrease the amount of force necessary to disengage the trigger sear surface from the hammer sear surface, it has been taught to polish the trigger sear surface and hammer sear surface to reduce the friction between the two. However, decreasing the amount of force required to pull the trigger can increase the possibility for an unintentional discharge of the firearm.

To protect against an unintentional discharge of the firearm, firearm and trigger manufacturers have designed and implemented various safety mechanisms. One such safety mechanism is the "half-cock" trigger found on many 1911 pistols. The "half-cock" is a notch in the hammer that engages the trigger sear surface, after the trigger sear surface has disengaged the hammer sear surface, to stop the hammer from further forward rotation towards the firing pin.

Applicant believes that if a trigger sear surface engages a "half-cock" surface of a hammer one or more times, the trigger sear surface may become rougher or smoother, which would impact the force or feeling of the trigger (i.e., the "trigger pull") when it is being operated to discharge the firearm. To address this concern, Applicant has developed new and improved trigger assemblies.

The present disclosure provides trigger assemblies that preserve the integrity of the trigger sear surface when the trigger assembly enters a "half-cocked", safety configuration. For instance, the present disclosure provides trigger assemblies for striking a firing pin of a firearm, the trigger assemblies comprising: a trigger having a trigger sear surface and a hammer having a hammer sear surface; wherein the hammer is rotatable a first angular distance from a stable cocked position to a stable safety position; wherein the hammer is rotatable a second angular distance from the stable cocked position to a stable uncocked position in contact with the firing pin; wherein in the stable cocked position the trigger sear surface engages the hammer sear surface; wherein in the stable safety position the trigger sear surface is free of engagement with the hammer; and wherein the first angular distance is at least half of the second angular distance.

The present disclosure also provides assemblies for a firearm having a firing pin, the assemblies comprising: a trigger having a trigger sear surface and a hammer having a hammer sear surface; wherein the hammer is rotatable from a cocked position to a partially-cocked position and from the cocked position to an uncocked position in contact with the firing pin; wherein in the cocked position the trigger sear surface engages the hammer sear surface and resists the hammer from rotating until the trigger sear surface is moved out of engagement with the hammer sear surface; wherein in the partially-cocked position the trigger sear surface is free of engagement with the hammer; and wherein in the partially-cocked position a trigger release barrier surface is arranged to engage a hammer release barrier surface to prevent movement of the trigger from releasing the hammer.

Further, the present disclosure teaches products comprising: a single-stage trigger and hammer assembly having a trigger with a trigger sear surface and a hammer with a hammer sear surface; wherein the hammer is rotatable from a static cocked position to a static safety position; wherein when the hammer is in the static cocked position the trigger sear surface engages the hammer sear surface; and wherein when the hammer is in the static safety position the trigger sear surface is free of engagement with the hammer.

As will be described in more detail below, the angular distance between the stable/static cocked position and the stable/static safety position can be at least half, preferably at least 60%, or more preferably at least 70% of the angular distance between the stable/static cocked position and the stable/static uncocked position wherein the hammer is engaged with the firing pin. In some instances, the angular distance between the stable/static cocked position and the stable/static safety position is at least 30° or preferably at least 40°.

In any of the disclosed embodiments, a trigger safety engagement surface can engage a hammer safety engagement surface, each engagement surface being different from the sear surfaces, in the stable/static safety position. In some instances, both the trigger safety engagement surface and the trigger sear surface are positioned on a forward end of the trigger.

Applicant also discloses that in any of the embodiments, a trigger release barrier surface can be arranged to engage a hammer release barrier surface to prevent movement of the trigger from releasing the hammer, when the assembly is in the stable/static safety position, and allowing the hammer to rotate into contact with the firing pin. In some arrangements, the hammer/trigger release barrier surface is transverse to the hammer/trigger safety engagement surface. In some instances, the trigger safety engagement surface is transverse to the trigger sear surface. It is also provided that the hammer release barrier surface can be tangential to an imaginary circle concentric with a hammer axis of rotation about which the hammer rotates.

In any of the arrangements, the hammer can define a recess arranged to receive the trigger sear surface in the stable safety position. Similarly, in any of the arrangements, the trigger assembly and/or components thereof may be of a single stage trigger assembly.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
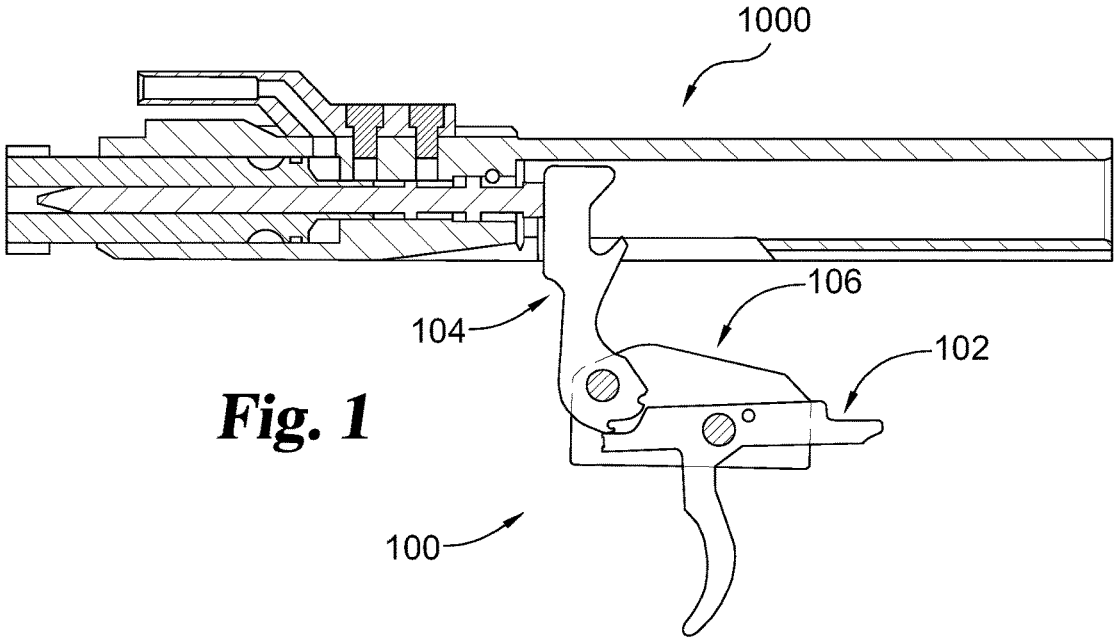
FIG. 1 is a cross-sectional view of a bolt carrier group and trigger assembly.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "upper", "lower", "bottom", "forward", "rearward" and the like, are us ed herein solely for the convenience of the reader in order to aid in the reader's understanding of the illustrated embodiments, and it is not the intent that the use of these directional terms in any manner limit the described, illustrated, and/or claimed features to a specific direction and/or orientation.

FIG. 1 illustrates an embodiment of the present disclosure, the embodiment including a trigger assembly 100 cooperating with a bolt carrier group 1000 for a firearm. The trigger assembly includes a single-stage trigger and hammer assembly comprising a trigger 102, a hammer 104, and a connecting member 106 that retains rotational axes of the trigger and the hammer in position relative to one another.

Figure 2:
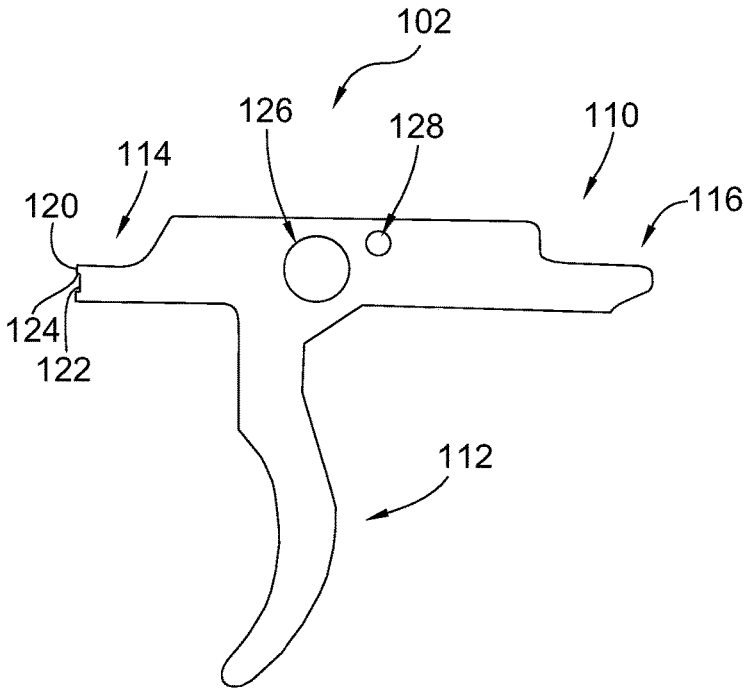
FIG. 2 is a side view of a trigger.

As shown in FIG. 2, the trigger has an upper portion 110, a lower portion 112, a forward portion 114, and a rearward portion 116. The upper portion is arranged to be positioned within a stock or receiver of a firearm (e.g., a lower receiver of an M16 or AR style firearm) with the lower portion extending below and outward of the stock/receiver to be manipulable by a user in firing the firearm. Positioned at a forward end of the trigger are a trigger sear surface 120, a trigger safety engagement surface 122 different from the trigger sear surface, and a trigger release barrier surface 124, which are each arranged to engage different portions of the hammer during certain configurations. The rearward portion of the trigger is arranged to engage a fire control mechanism (e.g., a safety selector) and support a disconnector (not shown). The trigger defines a forward, trigger pin opening 126 arranged to receive a trigger pin for pivotally coupling the trigger to the connecting member and/or to the stock/receiver of the firearm. The trigger defines a rearward, disconnector pin opening 128 arranged to receive a disconnector pin for pivotally coupling the disconnector to the trigger.

Figure 3:
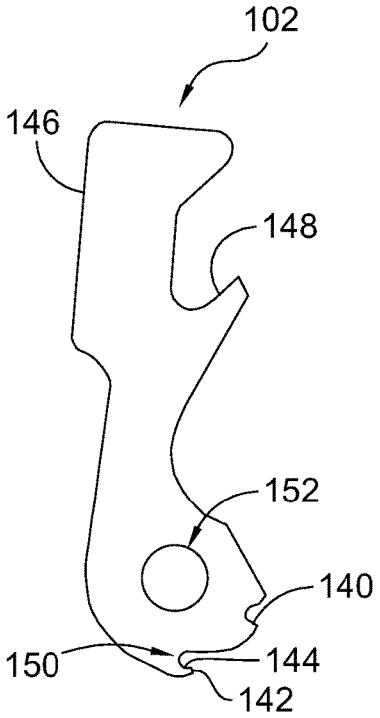
FIG. 3 is a side view of a hammer.

The hammer, illustrated in FIG. 3, includes a hammer sear surface 140, a hammer safety engagement surface 142 different from the hammer sear surface, a hammer release barrier surface 144, a firing pin striking surface 146, and a disconnector engaging surface 148. A safety recess 150 for receiving the trigger sear surface on the forward end of the trigger is defined by the hammer, such as by the hammer safety engagement surface and/or the hammer release barrier surface. The hammer also defines a hammer pin opening 152 arranged to receive a hammer pin for pivotally coupling the hammer to the connecting member and/or to the stock/receiver of the firearm.

Figure 4:
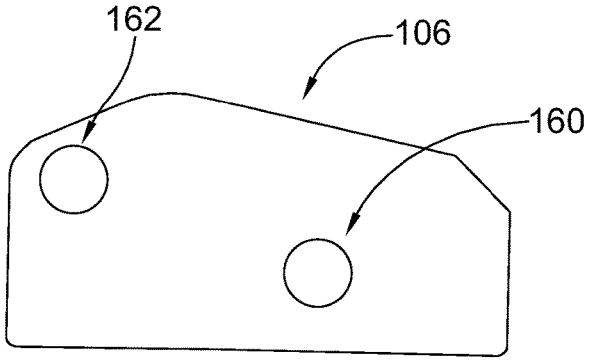
FIG. 4 is a side view of a coupling member.
Figure 5:
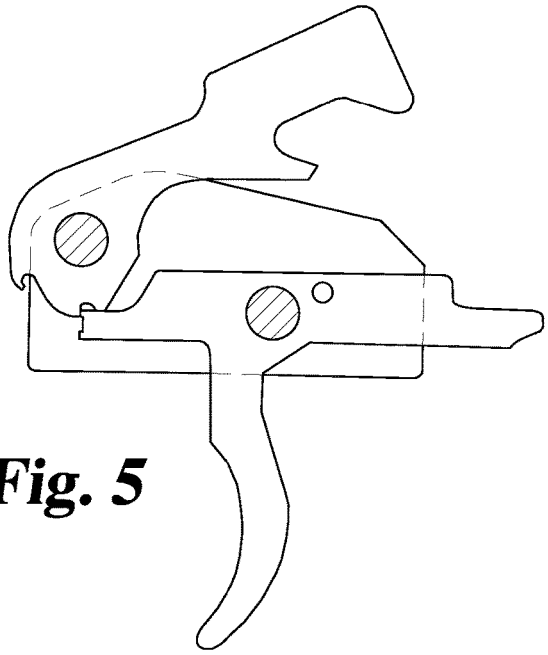
FIG. 5 is a side view of a trigger assembly in a stable, cocked position.
Figure 6:
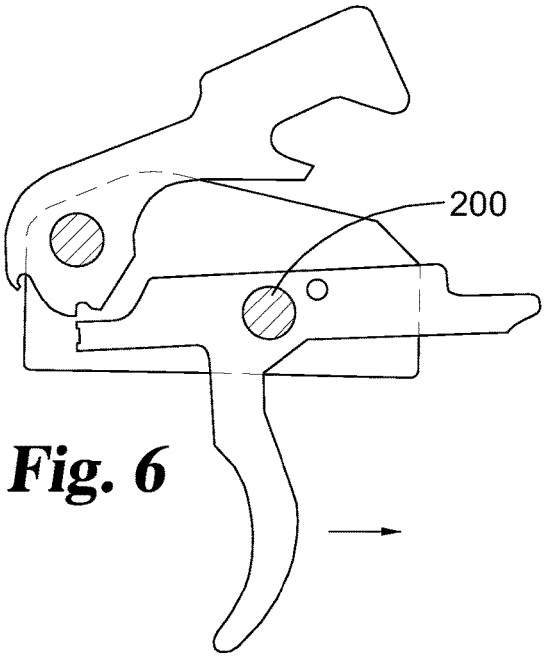
FIGS. 6, 7 and 8 are side views of the trigger assembly illustrating the transition to the stable, uncocked position from the stable, cocked position.
Figure 7:
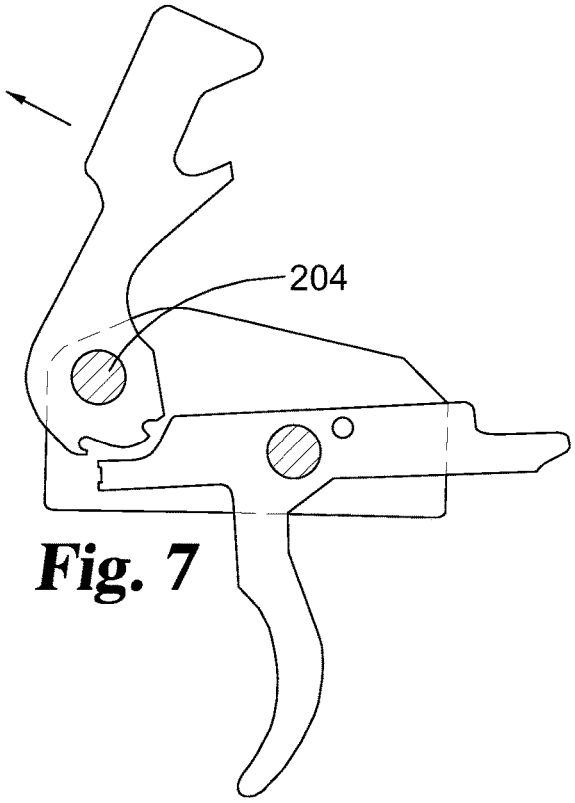

The connecting member, illustrated in FIG. 4, defines a trigger pin opening 160 and a hammer pin opening 162. The trigger pin opening is arranged to receive the trigger pin received within the forward, trigger pin opening of the trigger to pivotally couple the trigger to the coupling member. Similarly, the hammer pin opening is arranged to receive the hammer pin received within the hammer pin opening of the hammer to pivotally couple the hammer to the coupling member and to the trigger. The trigger pin opening and the hammer pin opening of the connecting member, in many instances, are arranged to align with corresponding openings for the trigger pin and the hammer pin in the lower receiver of an M16/AR style firearm.

FIGS. 5-8 illustrate operation of the trigger assembly during a firing mode. When in a stable cocked position, illustrated in FIG. 5, the trigger sear surface is engaged with the hammer sear surface and the hammer is cocked rearward. To fire the firearm, the operator forces the lower portion of the trigger rearward, illustrated by the directional arrow in FIG. 6, causing the trigger to rotate counter-clockwise around a trigger pin 200, the forward end of the trigger to move downward, and the trigger sear surface to disengage from the hammer sear surface.

Figure 8:
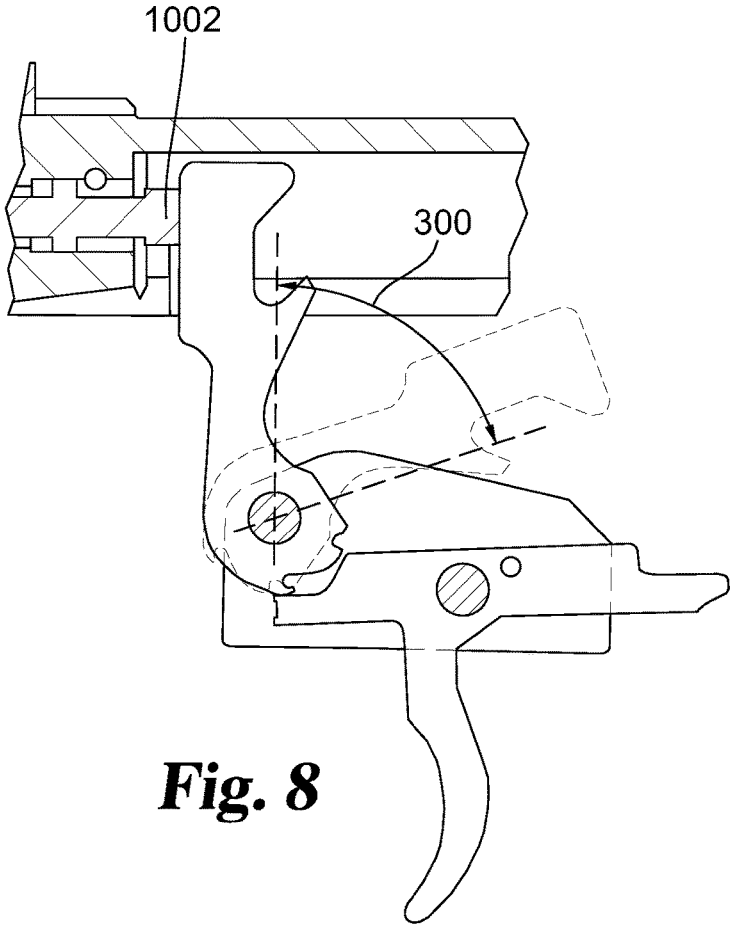
Figure 9:
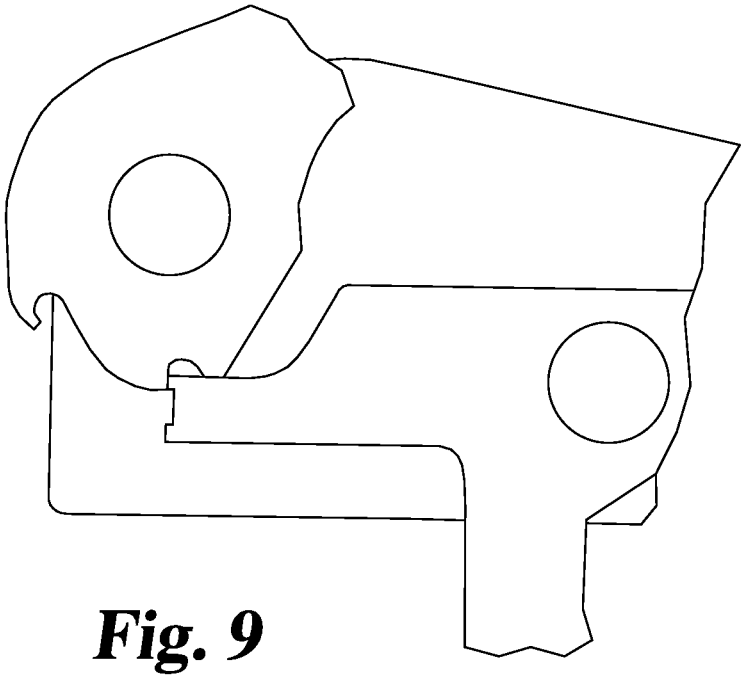
FIGS. 9, 10, 11 and 12 are partial side views of the trigger assembly illustrating the transition from the stable, cocked position to the stable, safety position.
Figure 10:
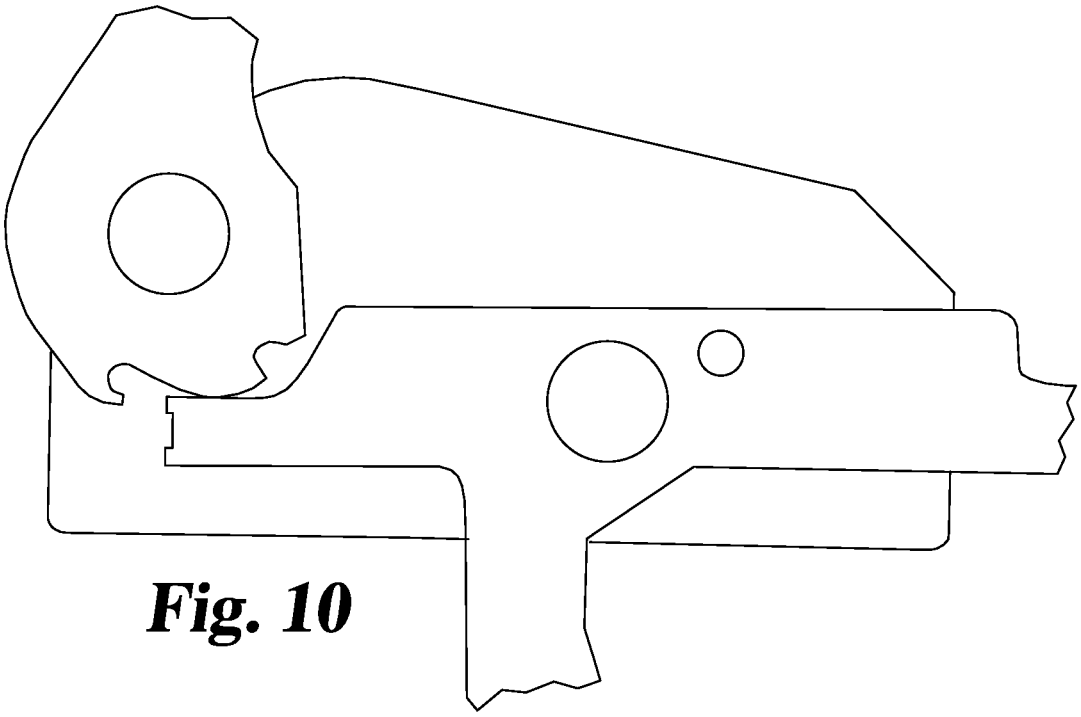
Figure 11:
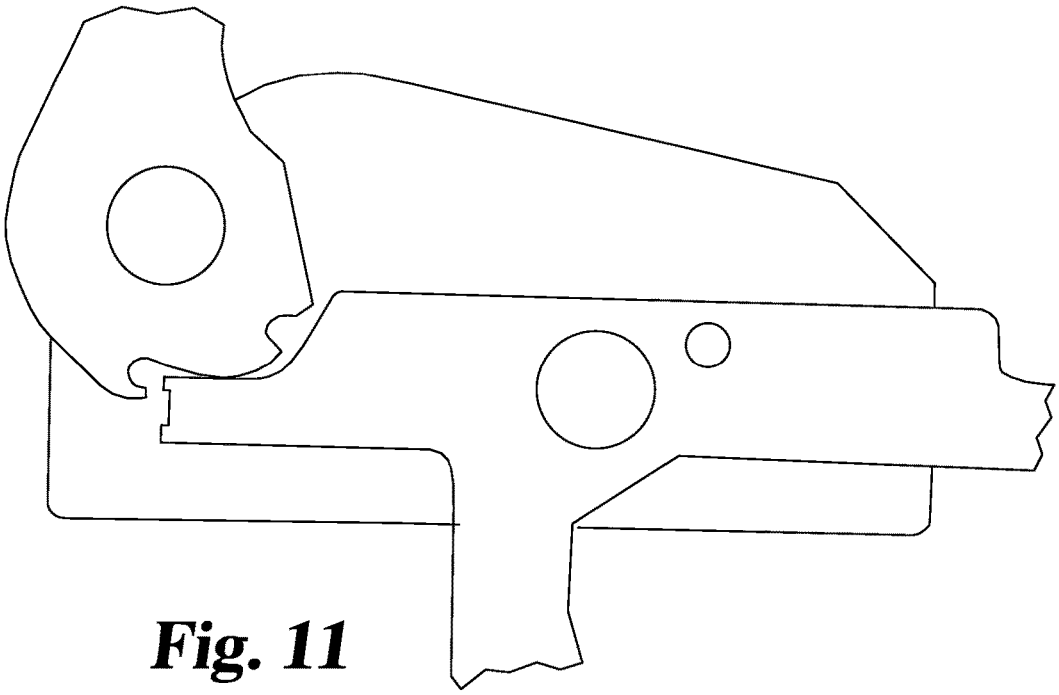
Figure 12:
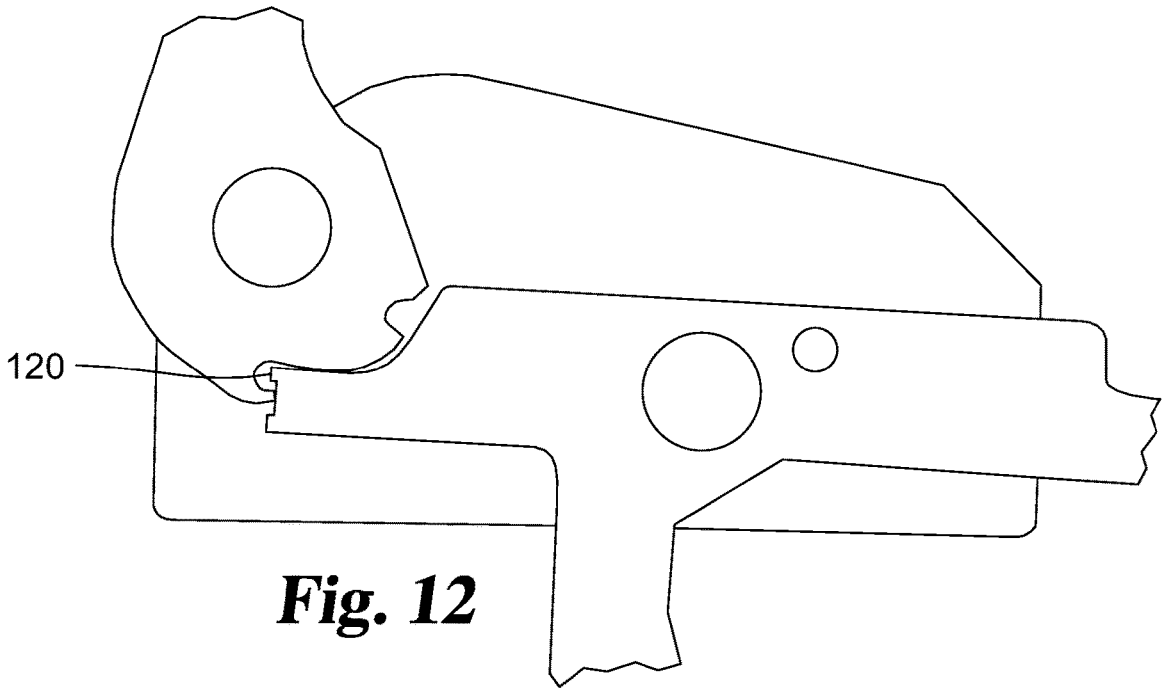
Figure 13:
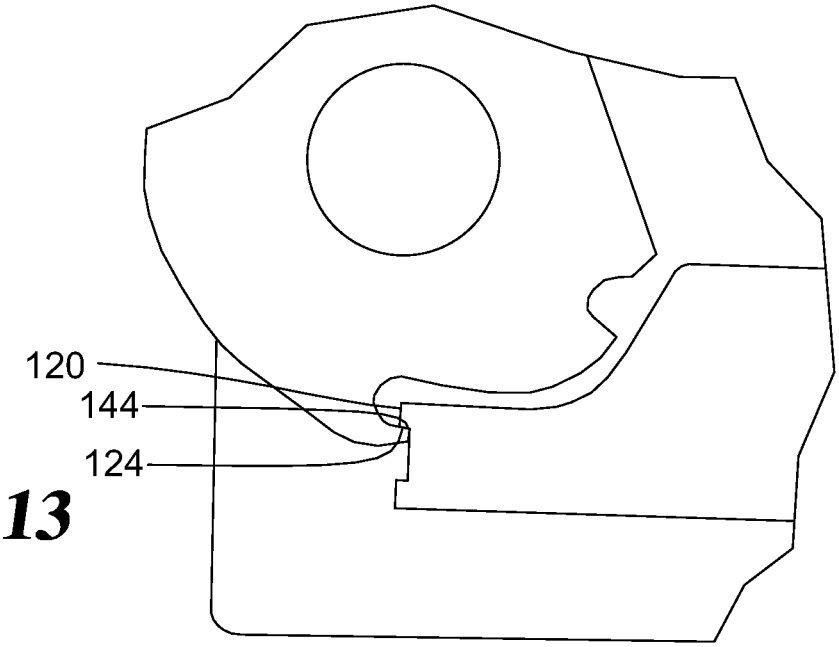
FIG. 13 is a partial side view of the trigger assembly illustrating the trigger assembly in the stable, safety position with a rearward force being exerted on the lower portion of the trigger.

When the trigger sear surface is disengaged from the hammer sear surface, the hammer is free to rotate forward under force from a hammer spring (not shown). As the hammer rotates forward in a counter-clockwise direction around a hammer pin 204, illustrated in FIG. 7, the hammer safety engagement surface and the hammer release barrier surface rotate towards and past the trigger safety engagement surface and the trigger release barrier surface. When positioned within a firearm, the firing pin striking surface of the hammer then strikes the firing pin 1002 positioned within a bolt and a bolt carrier of the firearm, causing the firing pin to move forward and strike a primer on a cartridge positioned within the breach of the firearm. As illustrated in FIG. 8, the hammer rotates an angular distance 300 from the stable cocked position to the position at which the firing pin striking surface of the hammer engages the firing pin (e.g., the "uncocked position").

FIGS. 9-14 illustrate operation of the trigger assembly during a safety engagement mode. Starting again in the stable cocked position, illustrated in FIG. 9, the trigger sear surface is engaged with the hammer sear surface and the hammer is cocked rearward. In rare circumstances, such as dropping the weapon, the trigger sear surface may disengage from the hammer sear surface allowing the hammer to rotate forward. If a force external to the firearm is not maintained on the trigger, the forward end of the trigger will be forced upward under the biasing force of a trigger spring (not shown). As the hammer rotates forward and the forward end of the trigger is forced upward, the trigger sear surface will move into the safety recess defined by the hammer and the hammer safety engagement surface will engage the trigger safety engagement surface so as to effectively stop further forward rotation of the hammer (shown in FIGS. 10-12). The trigger assembly is now in a stable safety position (e.g., a "partially-cocked" position). Advantageously, the trigger sear surface 120 is free of engagement with the hammer when the trigger engages the hammer in the stable safety position. Such an arrangement aides to preserve the integrity of the trigger sear surface (e.g., preserve the surface finish) so as to not impact the "trigger pull" of the trigger assembly.

If a rearward force is exerted on the lower portion of the trigger when the trigger assembly is in the stable safety position, the trigger release barrier surface 124 engages the hammer release barrier surface 144 and prevents the trigger from disengaging from the hammer which would allow the hammer to rotate further forward. In some embodiments, the hammer/trigger release barrier surface is transverse to the hammer/trigger safety engagement surface. For example, the hammer release barrier surface may be transverse to the hammer safety engagement surface and/or the trigger release barrier surface may be transverse to the trigger safety engagement surface. In some instances, the hammer/trigger release barrier surface is tangential to an imaginary circle that is concentric with a hammer axis of rotation about which the hammer rotates (e.g., the hammer pin).

Figure 14:
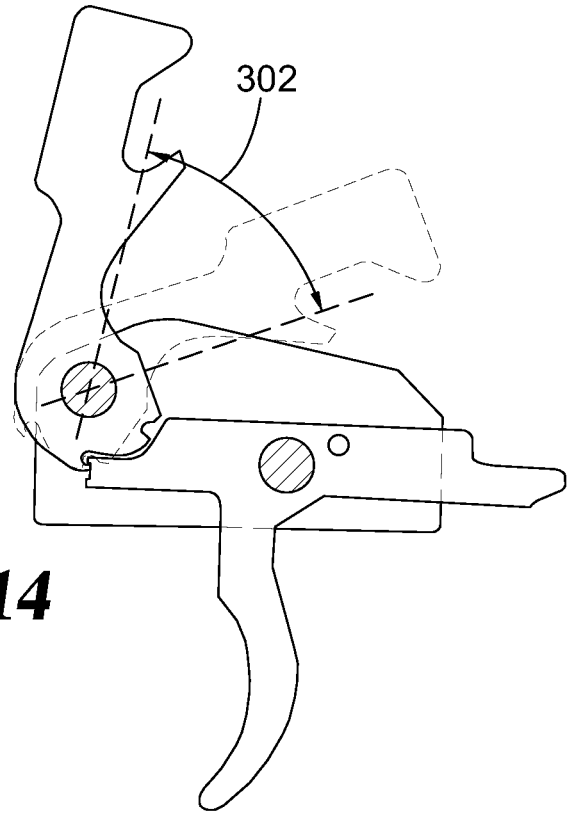
FIG. 14 is a side view of the trigger assembly in the stable, safety position with the stable, cocked position shown in phantom.

As illustrated in FIG. 14, the hammer rotates about the hammer pin an angular distance 302 from the stable cocked position to the stable safety position. In some instances, the angular distance from the stable cocked position to the stable safety position is at least 30° or at least 40°. In some particular embodiments, the angular distance is about 50°. In comparison, the angular distance 302 can be at least half of the angular distance 300. In some embodiments, the angular distance 302 is at least 60% or at least 70% of the angular distance 300.

Figure 15:
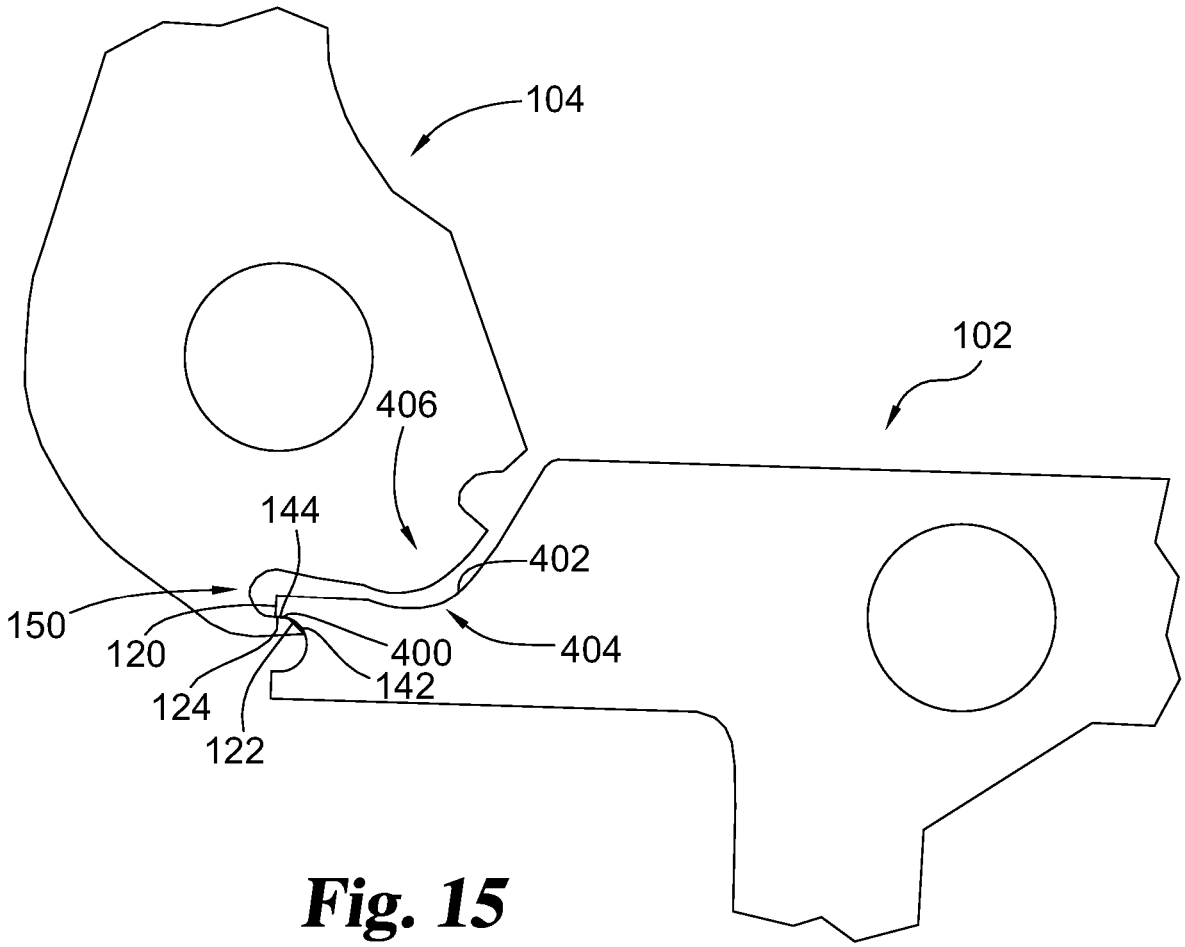
FIG. 15 is a partial side view of another embodiment of a trigger assembly.

FIG. 15 illustrates another trigger assembly wherein the trigger sear surface 120 is free of engagement with the hammer 104 when in the stable safety position. In this embodiment, the trigger includes a rounded transition 400 from the trigger sear surface 120 and/or trigger release barrier surface 124 to the trigger safety engagement surface 122. Advantageously, including a rounded transition in this area can reduce the possibility of a stress fracture occurring at the forward end of the trigger. Additionally, the rounded transition may be formed using the same tool used to cut the profile of the trigger without requiring the trigger to be reoriented.

FIG. 15 also illustrates the trigger release barrier surface transverse to the trigger sear surface (e.g., a tangent to a curve defined by the portion of the trigger release barrier surface adjacent the trigger sear surface is transverse to the trigger sear surface), and wherein the trigger release barrier surface is tangent to an imaginary circle that is concentric with the hammer axis of rotation. However, alternative angles and curves of the trigger release barrier surface are envisioned.

A top surface 402 of the trigger in FIG. 15 defines a recess 404 arranged to receive a portion 406 of the hammer following the hammer sear surface as the hammer rotates forward from the stable cocked position. Advantageously, the recess in the top surface of the trigger allows trigger sear surface to move further upward during rotation of the hammer to ensure the trigger sear surface avoids engagement with the hammer (e.g., the hammer safety engagement surface) when the assembly enters the stable safety position.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected.

The following numbered clauses set out specific embodiments that may be useful in understanding the present invention:

1. A trigger assembly for striking a firing pin of a firearm, the trigger assembly comprising:

a trigger having a trigger sear surface and a hammer having a hammer sear surface;

wherein the hammer is rotatable a first angular distance from a stable cocked position to a stable safety position;

wherein the hammer is rotatable a second angular distance from the stable cocked position to a stable uncocked position in contact with the firing pin;

wherein in the stable cocked position the trigger sear surface engages the hammer sear surface;

wherein in the stable safety position the trigger sear surface is free of engagement with the hammer; and wherein the first angular distance is at least half of the second angular distance.

2. The trigger assembly of clause 1, wherein the first angular distance is at least 60% of the second angular distance.

3. The trigger assembly of any preceding clause, wherein the first angular distance is at least 70% of the second angular distance.

4. The trigger assembly of any preceding clause, wherein the first angular distance is at least 30°.

5. The trigger assembly of any preceding clause, wherein the first angular distance is at least 40°.

6. The trigger assembly of any preceding clause, wherein in the stable safety position a trigger safety engagement surface engages a hammer safety engagement surface;

wherein the trigger safety engagement surface is different from the trigger sear surface; and wherein the hammer safety engagement surface is different from the hammer sear surface.

7. The trigger assembly of clause 6, wherein both the trigger safety engagement surface and the trigger sear surface are positioned on a forward end of the trigger.

8. The trigger assembly of any preceding clause, wherein in the stable safety position a trigger release barrier surface of the trigger is arranged to engage a hammer release barrier surface of the hammer to prevent movement of the trigger from releasing the hammer and allowing the hammer to rotate into contact with the firing pin.

9. The trigger assembly of clause 8 as dependent from clause 6 or 7, wherein the hammer release barrier surface is transverse to the hammer safety engagement surface.

10. The trigger assembly of clause 8, wherein the hammer rotates around a hammer axis of rotation and the hammer release barrier surface is tangential to an imaginary circle concentric with the hammer axis of rotation.

11. The trigger assembly of any preceding clause, wherein the hammer defines a recess arranged to receive the trigger sear surface in the stable safety position.

12. The trigger assembly of any preceding clause, wherein the trigger assembly is a single stage trigger assembly.

13. An assembly for a firearm having a firing pin, the assembly comprising:

a trigger having a trigger sear surface and a hammer having a hammer sear surface;

wherein the hammer is rotatable from a cocked position to a partially-cocked position and from the cocked position to a uncocked position in contact with the firing pin;

wherein in the cocked position the trigger sear surface engages the hammer sear surface and resists the hammer from rotating until the trigger sear surface is moved out of engagement with the hammer sear surface;

wherein in the partially-cocked position the trigger sear surface is free of engagement with the hammer; and wherein in the partially-cocked position a trigger release barrier surface of the trigger is arranged to engage a hammer release barrier surface of the hammer to initially prevent further movement of the trigger from releasing the hammer.

14. The assembly of clause 13, wherein the trigger sear surface is positioned on a forward end of the trigger.

15. The assembly of any one of clauses 13-14, wherein the trigger release barrier surface is transverse to the trigger sear surface.

16. The assembly of any one of clauses 13-15, wherein the hammer rotates around a hammer axis of rotation and the hammer release barrier surface is tangential to an imaginary circle concentric with the hammer axis of rotation.

17. The assembly of any one of clauses 13-16, wherein the hammer defines a recess arranged to receive the trigger sear surface in the partially-cocked position.

18. The assembly of any one of clauses 13-17, wherein the trigger and hammer are a single stage trigger and a single stage hammer.

19. A product, comprising:

a single-stage trigger and hammer assembly having a trigger with a trigger sear surface and a hammer with a hammer sear surface;

wherein the hammer is rotatable from a static cocked position to a static safety position;

wherein when the hammer is in the static cocked position the trigger sear surface engages the hammer sear surface; and wherein when the hammer is in the static safety position the trigger sear surface is free of engagement with the hammer.

20. The product of clause 19, wherein in the static safety position a trigger safety engagement surface engages a hammer safety engagement surface.

What is claimed is:

1. A trigger assembly for striking a firing pin of a firearm, the trigger assembly comprising:

a hammer having a stable cocked position, a stable safety position, and a stable uncocked position;

the hammer having a hammer sear surface and a hammer safety engagement surface different from the hammer sear surface;

a trigger having a forward portion with a first area and a second area different from the first area;

wherein in the stable cocked position a first area of the forward portion of the trigger contacts the hammer sear surface;

wherein in the stable safety position the second area of the forward portion of the trigger contacts the hammer safety engagement surface and the first area is not in contact with the hammer.

2. The trigger assembly of claim 1, wherein the second area of the forward portion of the trigger is adjacent to the first area.

3. The trigger assembly of claim 1, wherein the second area is parallel to the first area.

4. The trigger assembly of claim 3, wherein the second area is located closer to a rearward portion of the trigger than the first area.

5. The trigger assembly of claim 1, wherein in the stable safety position the second area is parallel to the hammer safety engagement surface.

6. The trigger assembly of claim 1, wherein the hammer defines a recess adjacent to the hammer safety engagement surface; and wherein in the stable safety position the hammer sear surface faces said recess.

7. The trigger assembly of claim 6, wherein the hammer sear surface is received within the recess defined by the hammer when in the stable safety position.

8. The trigger assembly of claim 1, wherein the second area is positioned radially outward from the first area relative to a rotation axis of the hammer.

9. The trigger assembly of claim 1, wherein the assembly is a drop-in trigger module comprising a housing that retains the trigger and hammer in relation to one another.

10. The trigger assembly of claim 1, wherein the hammer includes a disconnector engaging surface opposing a firing pin striking surface of the hammer.

11. The trigger assembly of claim 10, wherein the trigger defines a pin opening for pivotally connecting a disconnector thereto.

12. The trigger assembly of claim 1, wherein the hammer is rotatable a first angular distance from the stable cocked position to the stable safety position;

wherein the hammer is rotatable a second angular distance from the stable cocked position to the stable uncocked position; and wherein the first angular distance is at least half of the second angular distance.

13. The trigger assembly of claim 12, wherein the first angular distance is at least 60% of the second angular distance.

14. The trigger assembly of claim 12, wherein the first angular distance is at least 70% of the second angular distance.

15. The trigger assembly of claim 12, wherein the first angular distance is at least 30°.

16. The trigger assembly of claim 12, wherein the first angular distance is at least 40°.

17. The trigger assembly of claim 1, wherein the trigger assembly is a single stage trigger assembly.

18. The trigger assembly of claim 1, wherein in the stable safety position a trigger release barrier surface of the trigger is arranged to engage a hammer release barrier surface of the hammer to prevent movement of the trigger from releasing the hammer and allowing the hammer to rotate into contact with the firing pin.

19. The trigger assembly of claim 18, wherein the hammer release barrier surface is transverse to a hammer safety engagement surface that engages a trigger safety engagement surface when in the stable safety position.

20. A firearm comprising the trigger assembly of claim 1.

* * * * *